US012004706B2

(12) United States Patent
Liggett et al.

(10) Patent No.: US 12,004,706 B2
(45) Date of Patent: Jun. 11, 2024

(54) ROBOTIC CLEANER

(71) Applicant: SharkNinja Operating, LLC, Needham, MA (US)

(72) Inventors: Melinda L. Liggett, Watertown, MA (US); Isaku D. Kamada, Brighton, MA (US); Frederick K. Hopke, Medway, MA (US); Gan Sin Huat, Suzhou (CN); Charles Fiebig, Needham, MA (US); Scott Connor, Needham, MA (US); Alan Ai, Suzhou (CN)

(73) Assignee: SharkNinja Operating LLC, Needham, MA (US)

( * ) Notice: Subject to any disclaimer, the term of this patent is extended or adjusted under 35 U.S.C. 154(b) by 631 days.

(21) Appl. No.: 17/135,275

(22) Filed: Dec. 28, 2020

(65) Prior Publication Data

US 2021/0113044 A1 Apr. 22, 2021

Related U.S. Application Data

(63) Continuation of application No. 16/100,687, filed on Aug. 10, 2018, now Pat. No. 10,874,275.
(Continued)

(51) Int. Cl.
*A47L 9/28* (2006.01)
*A47L 9/00* (2006.01)

(52) U.S. Cl.
CPC ..... *A47L 9/2852* (2013.01); *A47L 9/009* (2013.01); *A47L 9/2805* (2013.01); *A47L 2201/00* (2013.01); *A47L 2201/04* (2013.01)

(58) Field of Classification Search
CPC ..... A47L 9/2852; A47L 9/009; A47L 9/2805; A47L 2201/00; A47L 2201/04
See application file for complete search history.

(56) References Cited

U.S. PATENT DOCUMENTS 3,744,077 A 7/1973 Smyth
5,293,955 A 3/1994 Lee
(Continued)

FOREIGN PATENT DOCUMENTS

CN 1683088 A 10/2005
CN 201019678 Y 2/2008
(Continued)

OTHER PUBLICATIONS

PCT Search Report and Written Opinion dated Oct. 19, 2018, received in corresponding PCT Application No. PCT/US18/46218, 10 pgs.
(Continued)

*Primary Examiner* — Marc Carlson
(74) *Attorney, Agent, or Firm* — Grossman Tucker Perreault & Pfleger, PLLC

(57) ABSTRACT

A robotic cleaner may include a housing, a bumper, driven wheels, and a controller. The bumper can be coupled to a front of the housing. The bumper may include a plurality of projections extending from a top edge of the bumper and above a top surface of the housing. The projections may include at least one leading projection proximate a forward most portion of the bumper and at least two side projections on each respective side of the bumper. The driven wheels may be rotatably mounted to the housing. The controller may be for controlling at least the driven wheels.

20 Claims, 7 Drawing Sheets

Related U.S. Application Data

(60) Provisional application No. 62/713,207, filed on Aug. 1, 2018, provisional application No. 62/555,468, filed on Sep. 7, 2017.

(56) References Cited

U.S. PATENT DOCUMENTS

| | | | | |
|---|---|---|---|---|
| 5,341,540 | A | 8/1994 | Soupert et al. | |
| 5,353,224 | A | 10/1994 | Lee et al. | |
| 5,781,960 | A | 7/1998 | Kilström et al. | |
| 5,903,124 | A | 5/1999 | Kawakami | |
| 5,935,179 | A | 8/1999 | Kleiner et al. | |
| 6,076,226 | A | 6/2000 | Reed | |
| 6,119,057 | A | 9/2000 | Kawagoe | |
| 6,327,741 | B1 | 12/2001 | Reed | |
| 6,459,955 | B1 | 10/2002 | Bartsch et al. | |
| 6,481,515 | B1 | 11/2002 | Kirkpatrick et al. | |
| 7,004,269 | B2 | 2/2006 | Song et al. | |
| 7,233,122 | B2 | 6/2007 | Kim et al. | |
| 7,343,221 | B2 | 3/2008 | Ann | |
| 7,474,941 | B2 | 1/2009 | Kim et al. | |
| 7,480,960 | B2 | 1/2009 | Kim | |
| 7,571,511 | B2 | 8/2009 | Jones et al. | |
| 7,615,957 | B2 | 11/2009 | Kim et al. | |
| 7,647,144 | B2 | 1/2010 | Haegermarck | |
| 7,673,367 | B2 | 3/2010 | Kim et al. | |
| 7,992,251 | B2 | 8/2011 | Chung et al. | |
| 8,301,304 | B2 | 10/2012 | Jung et al. | |
| 8,417,383 | B2 * | 4/2013 | Ozick | G05D 1/0231 700/258 |
| 8,521,329 | B2 | 8/2013 | Park et al. | |
| 8,575,892 | B2 | 11/2013 | Kim | |
| 8,801,057 | B2 | 8/2014 | Kim et al. | |
| 8,825,256 | B2 | 9/2014 | Kim et al. | |
| 8,950,792 | B2 | 2/2015 | Hickey et al. | |
| 9,004,553 | B2 | 4/2015 | Hickey et al. | |
| 9,078,552 | B2 | 7/2015 | Han et al. | |
| 9,104,204 | B2 | 8/2015 | Jones et al. | |
| 9,144,355 | B2 | 9/2015 | Jang et al. | |
| 9,346,426 | B2 | 5/2016 | Hickey et al. | |
| 9,414,734 | B2 | 8/2016 | Moon et al. | |
| 9,483,055 | B2 | 11/2016 | Johnson et al. | |
| 9,505,140 | B1 | 11/2016 | Fay et al. | |
| 10,130,233 | B2 | 11/2018 | Jang et al. | |
| 10,376,120 | B2 | 8/2019 | Neumann et al. | |
| 10,702,112 | B2 * | 7/2020 | Tsuboi | A47L 9/2894 |
| 2002/0124343 | A1 | 9/2002 | Reed | |
| 2004/0236468 | A1 | 11/2004 | Taylor et al. | |
| 2005/0021181 | A1 | 1/2005 | Kim et al. | |
| 2005/0217042 | A1 | 10/2005 | Reindle | |
| 2006/0021168 | A1 | 2/2006 | Nishikawa | |
| 2008/0281470 | A1 | 11/2008 | Gilbert, Jr. et al. | |
| 2010/0324734 | A1 * | 12/2010 | Lee | A47L 11/4002 700/258 |
| 2011/0140829 | A1 | 6/2011 | Veenstra | |
| 2012/0181099 | A1 | 7/2012 | Moon et al. | |
| 2012/0291809 | A1 | 11/2012 | Kuhe et al. | |
| 2012/0311813 | A1 | 12/2012 | Gilbert, Jr. et al. | |
| 2013/0054026 | A1 * | 2/2013 | Jang | G05D 1/0227 700/258 |
| 2013/0152332 | A1 | 6/2013 | Jang | |
| 2013/0204483 | A1 | 8/2013 | Sung et al. | |
| 2013/0211589 | A1 | 8/2013 | Landry et al. | |
| 2014/0130294 | A1 | 5/2014 | Li et al. | |
| 2014/0156076 | A1 | 6/2014 | Jeong et al. | |
| 2014/0188325 | A1 | 7/2014 | Johnson et al. | |
| 2014/0304937 | A1 | 10/2014 | Kim et al. | |
| 2015/0150429 | A1 * | 6/2015 | Yoo | A47L 11/4011 173/4 |
| 2016/0073839 | A1 | 3/2016 | Janzen et al. | |
| 2016/0075021 | A1 | 3/2016 | Cohen et al. | |
| 2016/0166127 | A1 | 6/2016 | Lewis | |
| 2016/0235270 | A1 | 8/2016 | Santini | |
| 2016/0259336 | A1 * | 9/2016 | Lee | A47L 9/2831 |
| 2017/0023942 | A1 | 1/2017 | Johnson et al. | |
| 2017/0150859 | A1 | 6/2017 | Muir | |
| 2018/0078106 | A1 | 3/2018 | Scholten et al. | |
| 2021/0113044 | A1 * | 4/2021 | Liggett | A47L 9/2805 |

FOREIGN PATENT DOCUMENTS

| | | | | |
|---|---|---|---|---|
| CN | 201591525 | | 9/2010 | |
| CN | 102218740 | A | 10/2011 | |
| CN | 203436287 | U | 2/2014 | |
| CN | 104095587 | | 10/2014 | |
| CN | 204016183 | U | 12/2014 | |
| CN | 104302218 | | 1/2015 | |
| CN | 205620809 | U | 10/2016 | |
| CN | 106660591 | | 5/2017 | |
| CN | 207041464 | | 2/2018 | |
| DE | 2251271 | A1 | 5/1974 | |
| DE | 10242257 | A1 | 4/2003 | |
| DE | 102007060750 | A1 | 6/2009 | |
| DE | 102015114775 | | 3/2017 | |
| EP | 3136196 | | 3/2017 | |
| GB | 248887 | A | 3/1926 | |
| GB | 1403860 | A | 8/1975 | |
| GB | 2404140 | A | 1/2005 | |
| JP | H0512958 | | 1/1993 | |
| JP | 09286337 | | 11/1997 | |
| JP | 2000353014 | A | 12/2000 | |
| JP | 2002318618 | | 10/2002 | |
| JP | 2002318618 | A | 10/2002 | |
| JP | 2011129155 | A * | 6/2011 | A47L 11/00 |
| JP | 2014137694 | | 7/2014 | |
| JP | 2015016008 | A | 1/2015 | |
| JP | 2015515922 | | 6/2015 | |
| JP | 2015156107 | | 8/2015 | |
| JP | 2015207206 | | 11/2015 | |
| JP | 2016168467 | A | 9/2016 | |
| JP | 2017153787 | | 9/2017 | |
| JP | 2018506312 | | 3/2018 | |
| KR | 1994000651 | | 7/1993 | |
| KR | 100640771 | B1 * | 10/2006 | |
| KR | 20140123174 | | 10/2014 | |
| WO | 2003024292 | | 3/2003 | |
| WO | 2014105220 | | 7/2014 | |
| WO | 2016130187 | | 8/2016 | |

OTHER PUBLICATIONS

PCT Search Report and Written Opinion dated Nov. 14, 2018, received in corresponding PCT Application No. PCT/IB18/56190, 9 pgs.

PCT Search Report and Written Opinion dated Oct. 25, 2019, received in PCT Application No. PCT/US19/44717, 9 pgs.

Chinese Office Action with English translation dated Jan. 5, 2021, received in Chinese Patent Application No. 201880064050.2, 10 pages.

United States Office Action dated May 14, 2020, received in U.S. Appl. No. 16/100,687, 18 pages.

Japanese Office Action with English translation dated Aug. 30, 2022, received in Japanese Patent Application No. 2021-137127, 8 pages.

Korean Office Action with English translation dated Nov. 15, 2022, received in Korean Patent Application No. 10-2021-7005845, 8 pages.

Japanese Office Action dated May 28, 2021, received in Japanese Pagent Application No. 2020-513324, 9 pages.

Chinese Office Action with English translation dated Jul. 13, 2021, received in Chinese Patent Application No. 201910707044.0, 106 pages.

European Extended Search Report dated Jul. 26, 2021, received in European Patent Application No. 18854359.9, 10 pages.

European Extended Search Report dated Aug. 10, 2021, received in European Patent Application No. 18846451.5, 8 pages.

Australian Examination Report dated Nov. 10, 2020, received in Australian Patent Application No. 2018329459, 5 pages.

Chinese Office Action dated Nov. 2, 2020 with English translation, received in Chinese Patent Application No. 201910707044.0, 14 pages.

(56) References Cited

OTHER PUBLICATIONS

Korean Office Action dated Aug. 23, 2021 with English translation, received in Korean Patent Application No. 10-2020-7009963, 13 pages.
English translation of Decision of Rejection dated Sep. 2, 2021, received in JP Patent Application No. 2020-508492, 8 pgs.
Chinese Office Action with English translation dated Sep. 24, 2021, received in Chinese Patent Application No. 201880064050.2, 11 pages.
Australian Office Action dated Nov. 26, 2021, received in Australian Patent Application No. 2019312668, 3 pages.
Chinese Decision of Rejection with English translation dated Jan. 6, 2022, received in Chinese Patent Application No. 201910707044.0, 9 pages.
Canadian Office Action dated Sep. 16, 2021, received in Canadian Patent Application No. 3,074,702, 3 pages.
Japanese Office Action with English translation dated Feb. 1, 2022, received in Japanese Patent Application No. 2020513324, 11 pages.
Korean Office Action with English translation dated Apr. 15, 2022, received in Korean Patent Application No. 10-2021-7005845, 16 pages.
U.S. Office Action dated Mar. 2, 2022, received in U.S. Appl. No. 16/529,496, 16 pages.
European Examination Report dated May 23, 2022, received in European Patent Application No. 18854359.9, 4 pages.
European Extended Search Report dated May 13, 2022, received in European Patent Application No. 19843316.1, 8 pages.
Japanese Office Action with English translation dated Feb. 22, 2021, received in Japanese Patent Application No. 2020-508492, 14 pages.
Chinese Office Action with English translation dated Feb. 23, 2021, received in Chinese Patent Application No. 201880058937.0, 12 pages.
Canadian Office Action dated Apr. 1, 2021, received in Canadian Application No. 3,074,702, 5 pgs.

* cited by examiner

ROBOTIC CLEANER

CROSS-REFERENCE TO RELATED APPLICATIONS

The present application is a continuation application of co-pending application Ser. No. 16/100,687 filed Aug. 10, 2018, which claims the benefit of U.S. Provisional Application Ser. No. 62/555,468, filed on Sep. 7, 2017, entitled ROBOTIC CLEANER, and U.S. Provisional Application Ser. No. 62/713,207, filed on Aug. 1, 2018, entitled ROBOTIC VACUUM CLEANER, each of which are fully incorporated herein by reference.

TECHNICAL FIELD

The present disclosure relates to robotic cleaners and particularly, a robotic vacuum cleaner.

BACKGROUND INFORMATION

Robotic cleaners have become an increasingly popular appliance for automated cleaning applications. In particular, robotic vacuum cleaners are used to vacuum surfaces while moving around the surfaces with little or no user interaction. Existing robotic vacuum cleaners include a suction system as well as various cleaning implements and agitators such as rotating brush rolls and side brushes. Similar to manually controlled vacuum cleaners, robotic vacuum cleaners face certain challenges with respect to capturing debris on a surface being cleaned. Robotic vacuum cleaners also face challenges with respect to autonomous navigation relative to obstacles within a room.

BRIEF DESCRIPTION OF THE DRAWINGS

These and other features and advantages will be better understood by reading the following detailed description, taken together with the drawings wherein.

DETAILED DESCRIPTION

Figure 1:
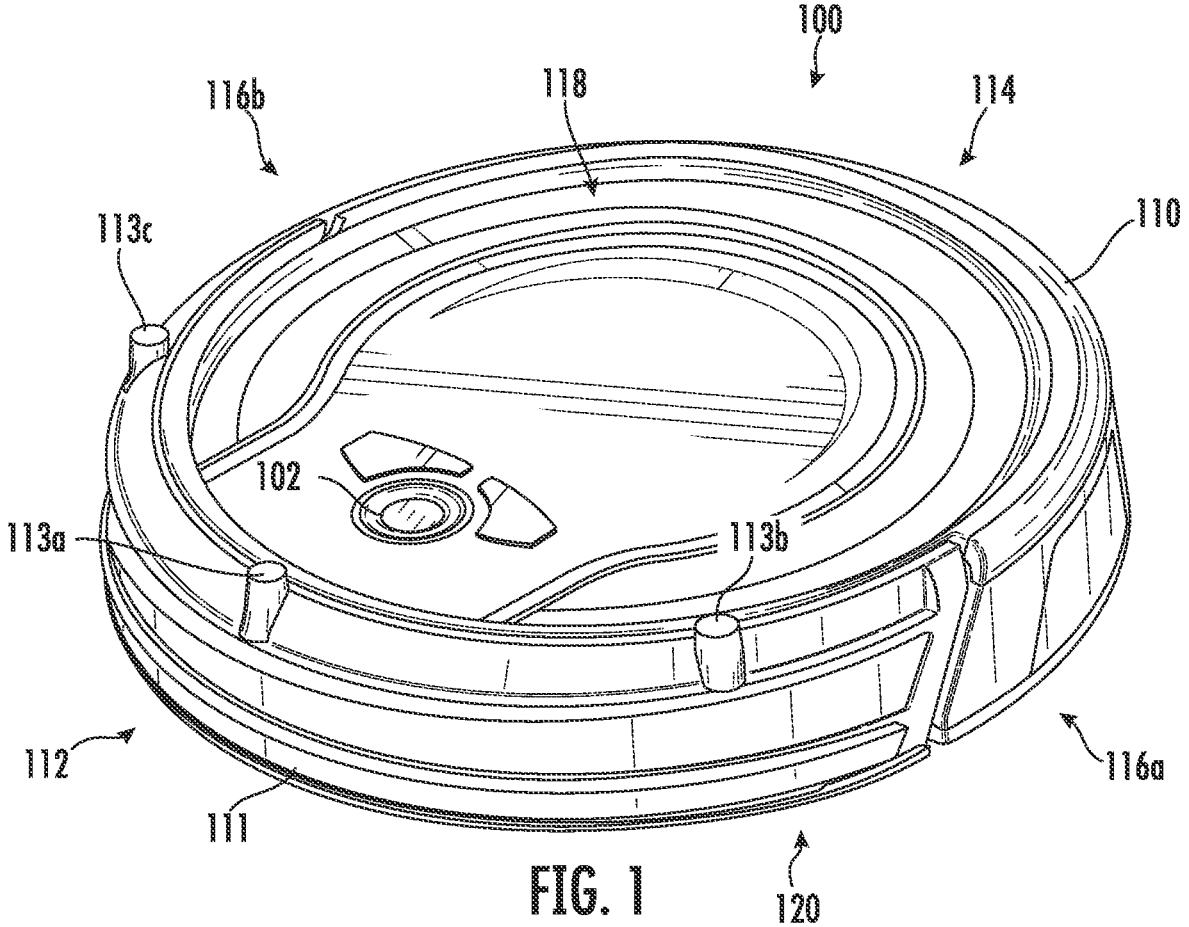
FIG. 1 is a perspective view of a robotic vacuum cleaner, consistent with embodiments of the present disclosure.

A robotic cleaning apparatus or robotic cleaner, consistent with an embodiment of the present disclosure is configured to detect obstacles resting on and spaced apart from a surface to be cleaned. For example, the robotic cleaner can include a bumper with a plurality of projections extending from a top edge of the bumper. The projections help prevent the robotic cleaner from becoming wedged under furniture and other obstacles. A robotic cleaner, consistent with another embodiment, includes at least one side brush having groups of bristles with one group of bristles longer than other groups of bristles. Having longer and shorter groups of bristles allows the side brush(es) to provide different sweeping radii and a wider sweeping area when rotating. A robotic cleaner, consistent with a further embodiment, includes a non-driven wheel with a plurality of optical rotation sensors coupled in an OR circuit configuration such that a single output is provided to a controller to indicate rotation/non-rotation of the non-driven wheel based on any of the rotation sensors. Having multiple rotation sensors coupled in an OR circuit configuration with one output provides a more efficient and reliable system for detecting rotation/non-rotation. A robotic cleaner, consistent with yet another embodiment, implements a threshold escape behavior by detecting when only one wheel drop sensor is activated and by rotating that one wheel back and forth in an attempt to escape. This threshold escape behavior prevents the robotic cleaner from falling if the robotic cleaner is precariously perched on a threshold.

Although one or more of the above features may be implemented in any type of robotic cleaner, an example embodiment is described as a robotic vacuum cleaner including one or more of the above features. The example embodiment of the robotic vacuum cleaner includes a generally round housing with a displaceable front bumper, a pair of drive wheels at the sides of the housing, a non-driven caster wheel at the front of the housing, a single main rotating brush roll, two rotating side brushes, a vacuum suction system, a rechargeable battery, and a removable dust container. The example embodiment of the robotic vacuum cleaner may also have various sensors around the housing including bump sensors, obstacle detection sensors, a side wall sensor, and cliff sensors. A power switch may be located on the side of the housing and control buttons may be located on the top of the housing for initiating certain operations (e.g., autonomous cleaning, spot cleaning, and docking). The robotic vacuum cleaner further includes hardware and software for receiving the sensor inputs and controlling operation in accordance with various algorithms or modes of operation. The robotic vacuum cleaner may also be provided with a charging base and a remote control. The robotic vacuum cleaner may also include hall sensors to detect magnetic strips, which provide virtual walls to confine movement of the robotic vacuum cleaner.

As used herein, the terms “above” and “below” are used relative to an orientation of the cleaning apparatus on a surface to be cleaned and the terms “front” and “back” are used relative to a direction that the cleaning apparatus moves on a surface being cleaned during normal cleaning operations (i.e., back to front). As used herein, the term “leading”

refers to a position in front of at least another component but does not necessarily mean in front of all other components.

Referring to FIGS. 1-5, an embodiment of a robotic vacuum cleaner 100, consistent with embodiments of the present disclosure, is shown and described. Although a particular embodiment of a robotic vacuum cleaner is shown and described herein, the concepts of the present disclosure may apply to other types of robotic vacuum cleaners or robotic cleaners. The robotic cleaner 100 includes a housing 110 with a front side 112, and a back side 114, left and right sides 116*a*, 116*b*, an upper side (or top surface) 118, and a lower or under side (or bottom surface) 120. A bumper 111 is movably coupled to the housing 110 around a substantial portion of the forward portion of the housing 110. The top of the housing 110 may include controls 102 (e.g., buttons) to initiate certain operations, such as autonomous cleaning, spot cleaning, and docking and indicators (e.g., LEDs) to indicate operations, battery charge levels, errors and other information.

In an embodiment, the bumper 111 includes a plurality of projections 113*a-c* (e.g., nubs) extending from a top edge of the bumper 111 and spaced around the bumper 111. The projections 113*a-c* are configured to contact overhanging edges of obstacles, such as furniture, to prevent the robotic cleaner 100 from becoming wedged under overhanging edges. Because the projections 113*a-c* extend from the bumper 111, the contact of any of the projections 113*a-c* with a portion of an obstacle will trigger a bump sensor.

Figure 3:
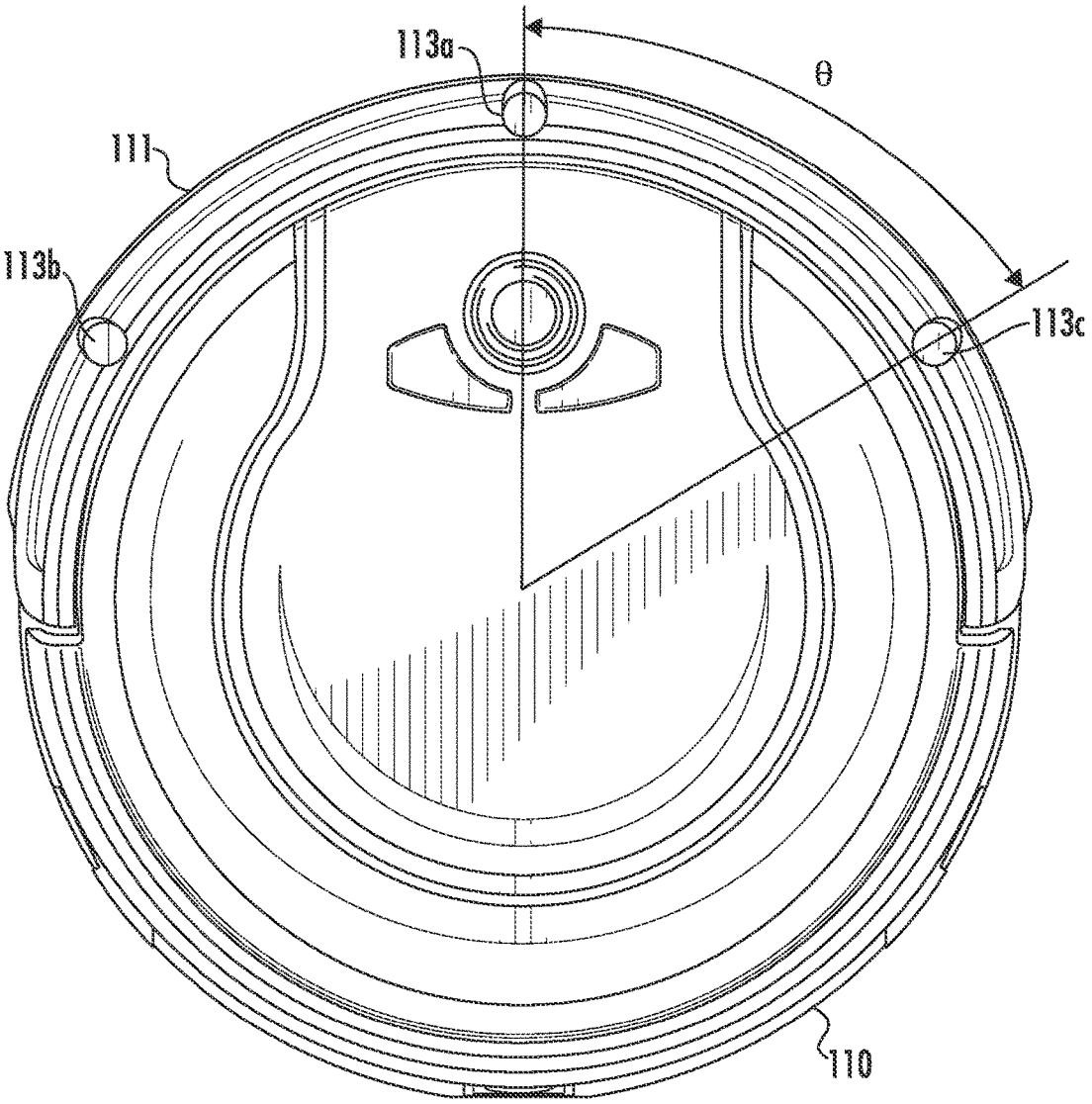
FIG. 3 is a top view of the robotic vacuum cleaner shown in FIG. 1.

In the illustrated example embodiment, a first or leading projection 113*a* is located at a forward most portion of the bumper 111 and second and third or side projections 113*b*, 113*c* are located on each side of the bumper 111. As shown in FIG. 3, the leading projection 113*a* is located at the forward most portion of the bumper 111 and the side projections 113*b*, 113*c* are spaced from the leading projection 113*a* with an angle θ in a range of about 30° to 70° and more specifically about 50° to 60°. This spacing of the projections 113*a-c* provides coverage around a substantial portion of the bumper 111. In other embodiments, different numbers and spacings of the projections are also possible and within the scope of the present disclosure.

Although the leading projection 113*a* is shown at the forward most portion of the bumper 111, the leading projection 113*a* could be located to one side of the forward most portion. The side projections 113*b*, 113*c* also are not required to be evenly spaced from the leading projection 113*a*. Although a limited number of projections (e.g., 3 projections) helps to minimize the vertical surface area and prevents the robotic cleaner from becoming wedged, other numbers of projections are possible and within the scope of the present disclosure.

Figure 2:
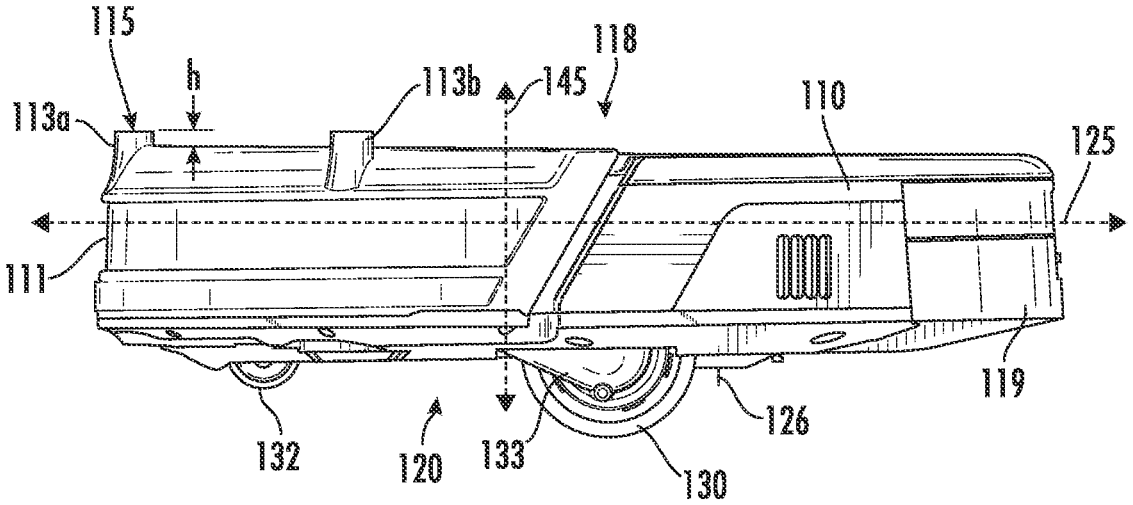
FIG. 2 is a side view of the robotic vacuum cleaner shown in FIG. 1.

In the illustrated example embodiment, the projections 113*a-c* have a substantially cylindrical shape providing an arcuate outer surface, which may also minimize the vertical surface area contacting obstacles. Other shapes are also within the scope of the present disclosure including, without limitation, oval, triangular or other polygonal shapes. The projections 113*a-c* may also have a top surface 115 that is concave to minimize the surface area that might become wedged under an overhanging obstacle. As shown in FIG. 2, the projections 113*a-c* may extend above the edge of the bumper 111 with a height h in a range of about 2 mm to 5 mm. Although shown with substantially the same height h, the projections 113*a-c* may also have different heights. For example, the leading projection 113*a* may be taller or shorter than the side projections 113*b*, 113*c*.

Additionally, or alternatively, the bumper 111 can be configured to move along at least two axes. For example, the bumper 111 can be configured to move along at least a forward bump axis 125 and an overhead bump axis 145. The forward bump axis 125 extends between the bumper 111 and a debris collector 119 in a direction generally parallel to a forward movement direction of the robotic cleaner 100 (i.e., front to back). The overhead bump axis 145 extends transverse to (e.g., perpendicular to) the forward bump axis 125 and/or a surface to be cleaned (e.g., through the top and the bottom of the robotic cleaner 100). At least a portion of the bumper 111 can be spaced apart from the housing 110 along the forward bump axis 125 and the overhead bump axis 145 a sufficient distance to allow the bumper 111 to move along the forward bump axis 125 and the overhead bump axis 145.

When the bumper 111 moves along the forward bump axis 125, it may be indicative of the robotic cleaner 100 encountering, for example, an obstacle positioned on and extending from a surface to be cleaned. For example, the robotic cleaner 100 may encounter a portion of a piece of furniture (e.g., a chair leg) which causes the bumper 111 to move along the forward bump axis 125. As a result, the robotic cleaner 100 may be caused to enter an obstacle avoidance behavior.

When the bumper 111 moves along the overhead bump axis 145, it may be indicative of the robotic cleaner 100 encountering, for example, an obstacle positioned above the surface to be cleaned. For example, the robotic cleaner 100 may attempt to travel under an overhanging obstacle (e.g., a portion of a couch extending between two or more supporting legs) which may cause the bumper 111 to move along the overhead bump axis 145 (e.g., in response to the bumper 111 contacting the overhead obstacle). Such a movement may be indicative of the robotic cleaner 100 attempting to enter an area in which it may become stuck (e.g., wedged between the surface to be cleaned and the obstacle). As a result, the robotic cleaner 100 may be caused to enter an obstacle avoidance behavior.

Figure 4:
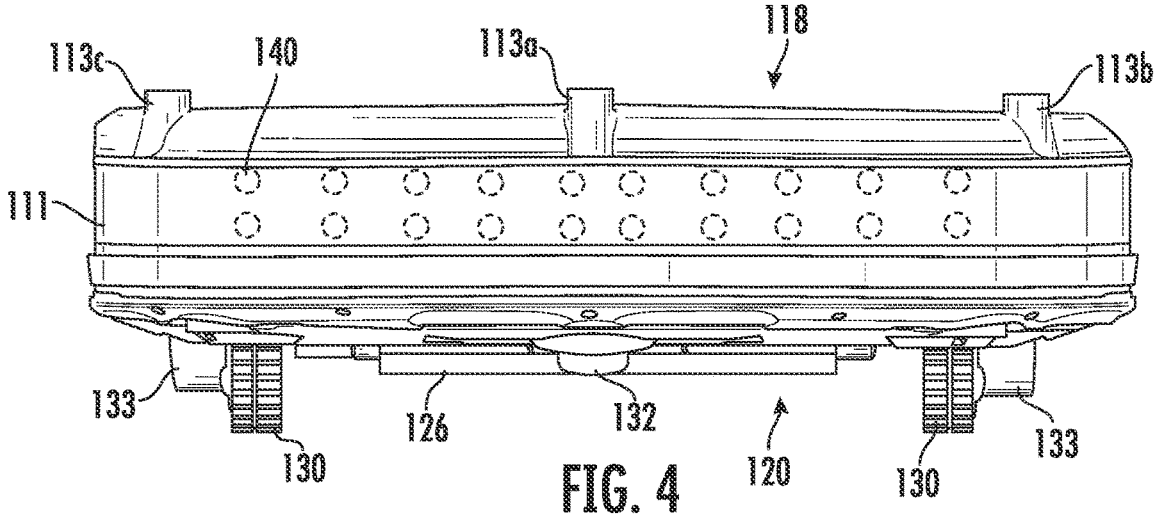
FIG. 4 is a front view of the robotic vacuum cleaner shown in FIG. 1.
Figure 5:
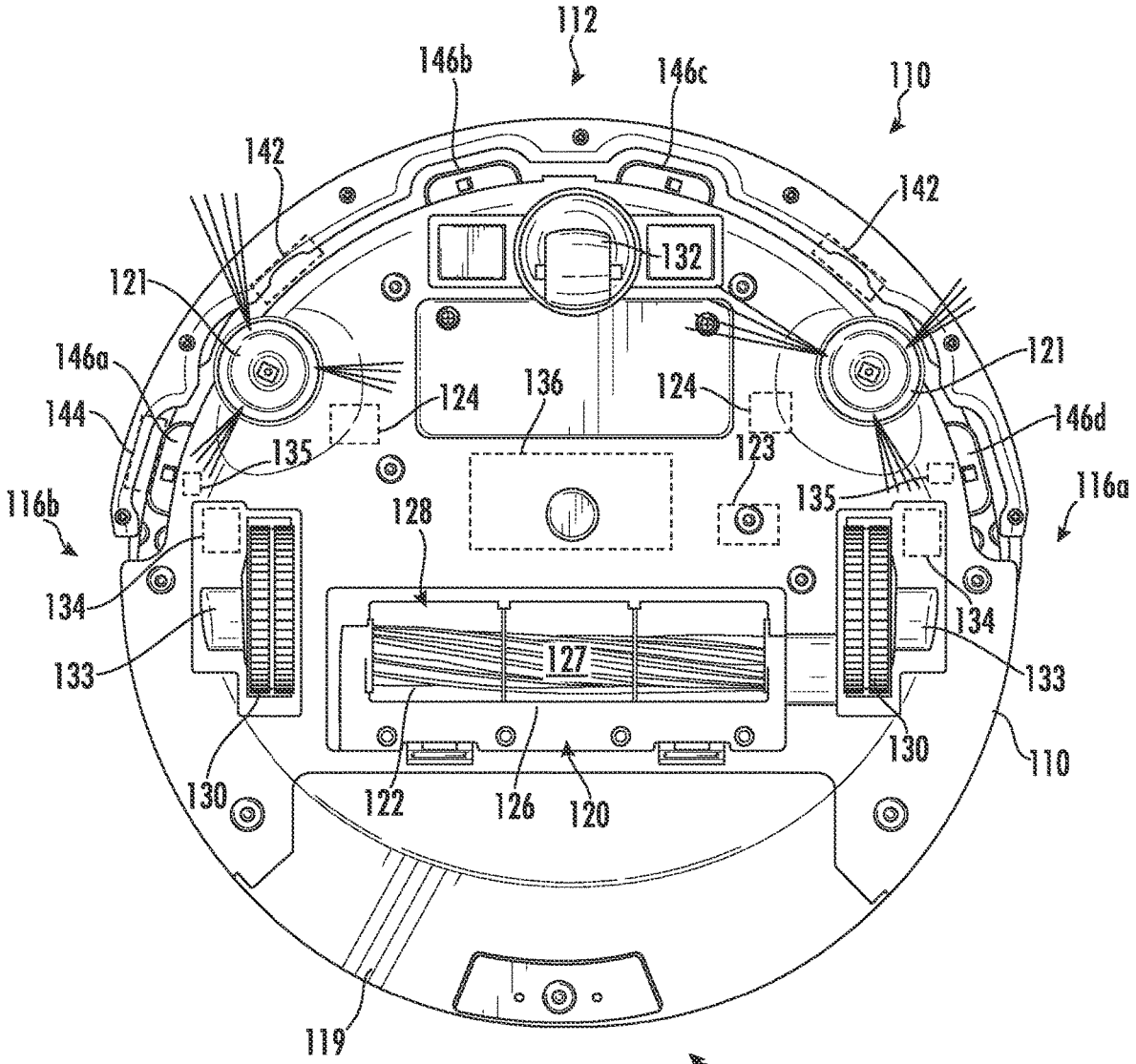
FIG. 5 is a bottom view of the robotic vacuum cleaner shown in FIG. 1 including a schematic illustration of the driving motors and controls.

In the illustrated example embodiment, as shown in FIG. 4, the housing 110 further defines a suction conduit 128 having an opening 127 on the underside 120 of the housing 110. The suction conduit 128 is fluidly coupled to a dirty air inlet (not shown), which may lead to a suction motor (not shown) in the robotic cleaner 100. The suction conduit 128 is the interior space defined by interior walls in the housing 110, which receives and directs air drawn in by suction, and the opening 127 is where the suction conduit 128 meets the underside 120 of the housing 110. The debris collector 119, such as a removable dust bin, is located in or integrated with the housing 110, for receiving the debris received through the dirty air inlet.

The robotic cleaner 100 includes a rotating agitator 122 (e.g., a main brush roll). The rotating agitator 122 rotates about a substantially horizontal axis to direct debris into the debris collector 119. The rotating agitator 122 is at least partially disposed within the suction conduit 128. The rotating agitator 122 may be coupled to a motor 123, such as AC or DC electrical motors, to impart rotation, for example, by way of one or more drive belts, gears or other driving mechanisms. The robotic cleaner also includes one or more driven rotating side brushes 121 coupled to motors 124 to sweep debris toward the rotating agitator 122, as will be described in greater detail below.

The rotating agitator 122 may have bristles, fabric, or other cleaning elements, or any combination thereof around the outside of the agitator 122. The rotating agitator 122 may include, for example, strips of bristles in combination with strips of a rubber or elastomer material. The rotating agitator 122 may also be removable to allow the rotating agitator 122 to be cleaned more easily and allow the user to change the size of the rotating agitator 122, change type of bristles on the rotating agitator 122, and/or remove the rotating agitator 122 entirely depending on the intended application. The robotic cleaner 100 may further include a bristle strip 126 on an underside of the housing 110 and along a portion of the suction conduit 128. The bristle strip 126 may include bristles having a length sufficient to at least partially contact the surface to be cleaned. The bristle strip 126 may also be angled, for example, toward the suction conduit 128.

The robotic cleaner 100 also includes driven wheels 130 and at least one non-driven wheel 132 (e.g., a caster wheel) for supporting the housing on the surface to be cleaned. The driven wheels 130 and the non-driven wheel 132 may provide the primary contact with the surface being cleaned and thus primarily support the robotic cleaner 100. The robotic cleaner 100 also includes drive motors 134 for driving the drive wheels 130 (e.g., independently). The robotic cleaner 100 may further include optical rotation sensors optically coupled to the non-driven wheel 132 for sensing rotation/non-rotation of the non-driven wheel 130, as will be described in greater detail below.

The driven wheels 130 may be mounted on suspension systems that bias the wheels 130 to an extended position away from the housing 110. The suspension systems may include, for example, pivoting gearboxes 133 that include the motor and gears that drive the wheels 130. During operation, the weight of the robotic cleaner 100 causes the suspension systems and the wheels 130 to retract at least partially into the housing 110. The robotic cleaner 100 may also include wheel drop sensors 135 (e.g., switches engaged by the pivoting gearboxes 133) to detect when the wheels 130 are in the extended position.

The robotic cleaner 100 also includes several different types of sensors. One or more forward obstacle sensors 140 (FIG. 4), such as infrared sensors integrated with the bumper, detect the proximity of obstacles in front of the bumper 111. One or more bump sensors 142 (e.g., optical switches behind the bumper) detect contact of the bumper 111 with obstacles during operation. One or more side wall sensors 144 (e.g., an infrared sensor directed laterally to a side of the housing) detect a side wall when traveling along a wall (e.g., wall following). Cliff sensors 146*a-d* (e.g., infrared sensors) located around a periphery of the underside of the housing 110 detect the absence of a surface on which the robotic cleaner 100 is traveling (e.g., staircases or other drop offs).

A controller 136 is coupled to the sensors (e.g., the bump sensors, wheel drop sensors, rotation sensors, forward obstacle sensors, side wall sensors, cliff sensors) and to the driving mechanisms (e.g., the agitator 122 drive motor 123, side brushes 121 drive motors 124, and the wheel drive motors 134) for controlling movement and other functions of the robotic cleaner 100. Thus, the controller 136 operates the drive wheels 130, side brushes 121, and/or agitator 122 in response to sensed conditions, for example, according to known techniques in the field of robotic cleaners. The controller 136 may operate the robotic cleaner 100 to perform various operations such as autonomous cleaning (including randomly moving and turning, wall following and obstacle following), spot cleaning, and docking. The controller 136 may also operate the robotic cleaner 100 to avoid obstacles and cliffs and to escape from various situations where the robot may become stuck. The controller may include any combination of hardware (e.g., one or more microprocessors) and software known for use in mobile robots.

In an embodiment, the robotic cleaner 100 is capable of performing a threshold escape behavior. When only one of the wheel drop sensors 135 is activated, the robotic cleaner 100 may be precariously perched on a threshold with one wheel 130 extended from the housing 110. In this situation, the cliff sensors 146*a-d* may not have triggered a cliff escape behavior (e.g., backing up) and driving both wheels may cause the robotic cleaner to fall off a cliff. For the threshold escape behavior, in response to detecting activation of the one wheel drop sensor 135, the controller 136 drives the motor 134 associated with that one extended wheel 130 to rotate the wheel back and forth while shutting down the other wheel. By driving the one wheel with the other wheel shut down, the robotic cleaner 100 may be able to escape without falling off a cliff if the robotic cleaner is precariously perched on a cliff. The wheel may be driven until the one wheel drop sensor is no longer activated or for a specified period of time. If the wheel drop sensor is still activated after a period of time and/or other sensors indicate that the robotic cleaner 100 might be stuck (e.g., elevated motor currents on the drive wheel motors), the cleaner may shut down and provide an alarm.

Figure 6:
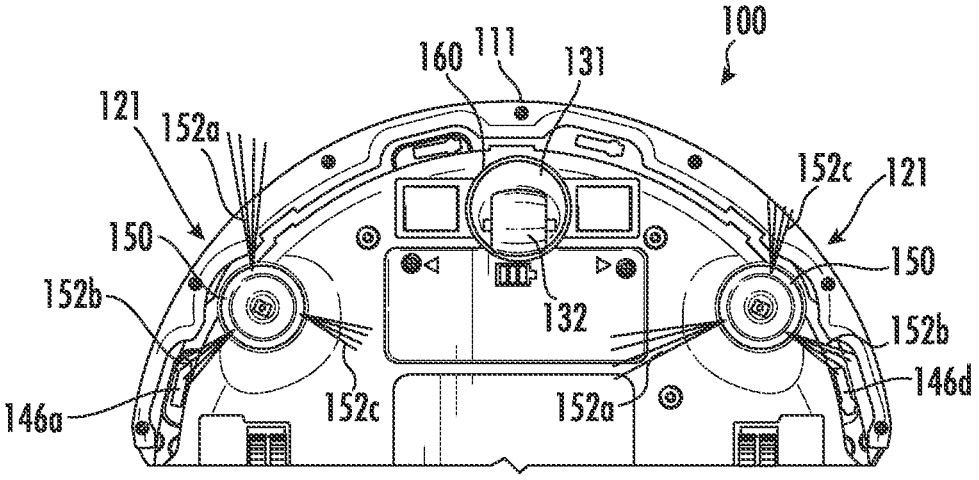
FIG. 6 is bottom view of the robotic vacuum cleaner illustrating the side brushes and non-driven wheel in greater detail.
Figure 7:
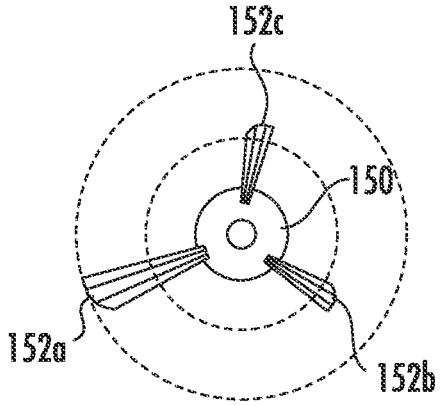
FIG. 7 is a schematic illustration of a side brush providing different sweeping radii.
Figure 8:
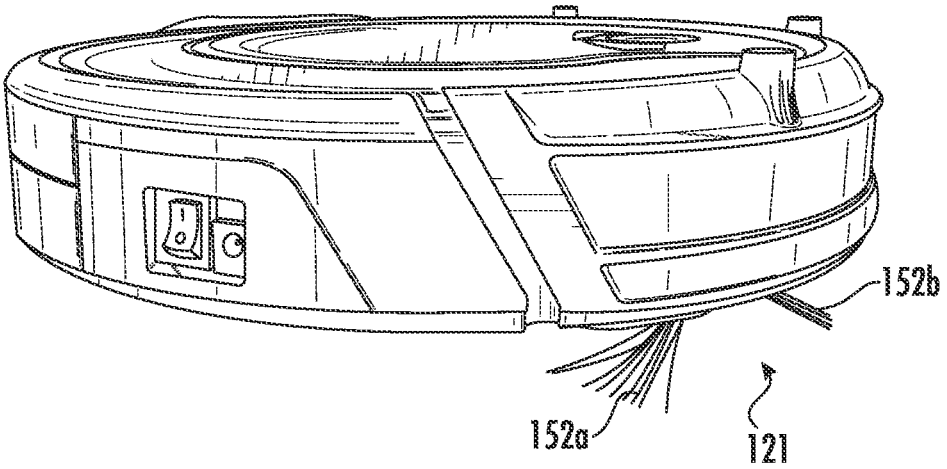
FIG. 8 is side view of the robotic vacuum cleaner shown in FIG. 6 showing a side brush with groups of bristles contacting a surface at different sweeping radii.

In another embodiment, as shown in FIGS. 6-8, the side brushes 121 include groups of bristles 152*a-c* extending from a hub 150 with one group of bristles 152*a* longer than the other groups of bristles 152*b*, 152*c*. The different lengths of the groups of bristles 152*a-c* allow different sweeping radii, as shown in FIG. 7, to allow the side brushes to contact the floor over a wider area. The longer group of bristles 152*a* may be long enough to pass between the side cliff sensors 146*a*, 146*d* and the floor, but the shorter groups of bristles 152*b*, 152*c* do not pass between the side cliff sensors 146*a*, 146*d* and the floor. Although the illustrated embodiment shows one longer group of bristles and two shorter groups of bristles, other numbers of groups and lengths are also contemplated and within the scope of the present disclosure. For example, a side brush may include groups of bristles all with different lengths.

In the illustrated embodiment, the shorter groups of bristles 152*b*, 152*c* are stiffer than the longer group of bristles 152*a*. The stiffness may be a result of the length, diameter, and/or material of the bristles. For example, the shorter groups of bristles 152*b*, 152*c* may also have thicker bristles to provide increased stiffness. In other embodiments, each group of bristles may have a different stiffness. The bristles may be made of nylon or other suitable materials for brushes in vacuum cleaners.

Figure 9:
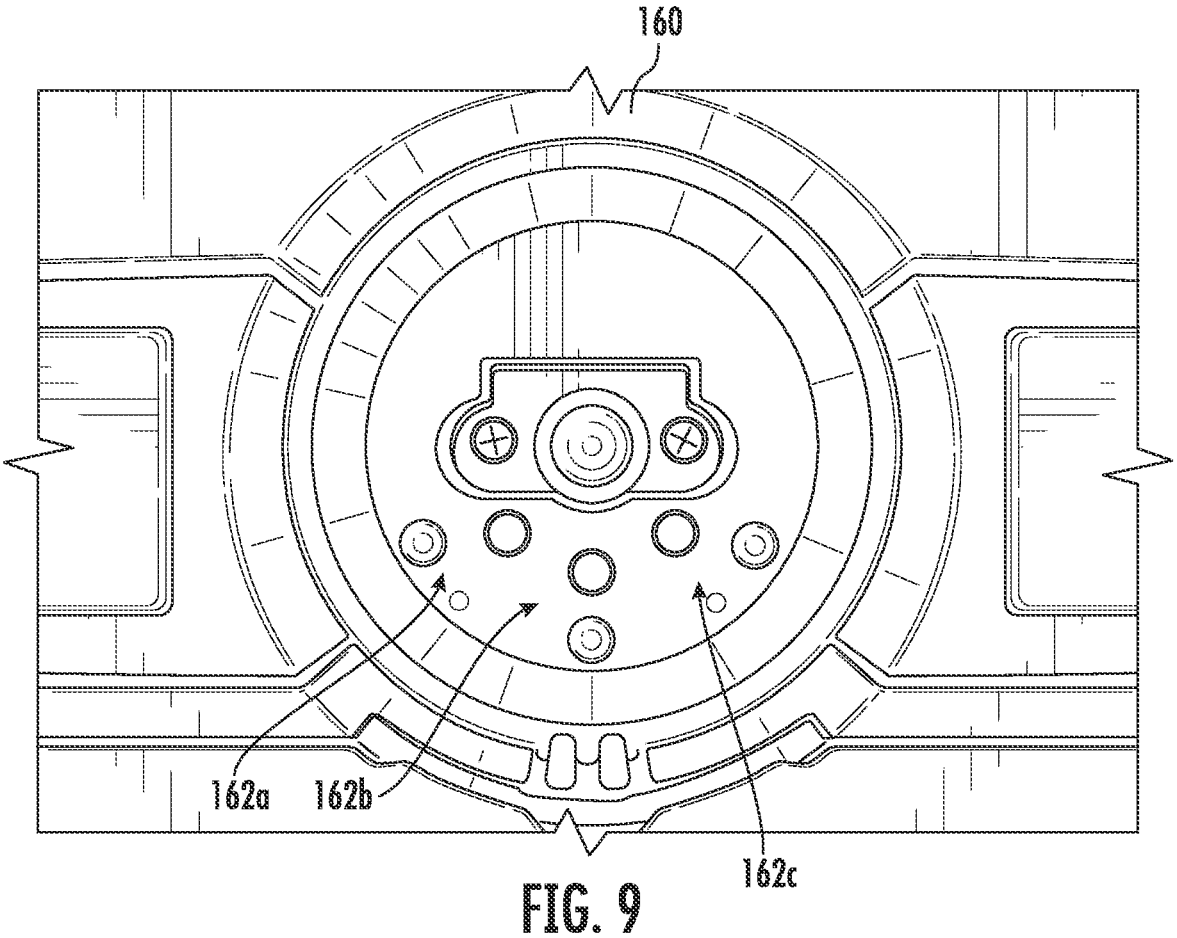
FIG. 9 is a bottom view of the robotic cleaner in FIG. 6 with the non-driven wheel assembly removed and illustrating the optical rotation sensors.

In a further embodiment, as shown in FIG. 9, a plurality of optical rotation sensors 162*a-c* are optically coupled to the non-driven wheel 132 (shown in FIG. 6) for sensing rotation or non-rotation of the wheel 132. The sensors 162*a-c* are located in a recess 160 that receives the non-driven wheel 132 (not shown in FIG. 9) and directed toward different locations on a surface of the wheel 132. Although three sensors 162*a-c* are shown, other numbers of sensors may also be used. In the illustrated embodiment, the non-driven wheel 132 is part of a caster wheel assembly 131 that is seated in the recess 160. An axle extends into an aperture in the recess 160 to allow rotation of the caster wheel assembly 131 about a substantially vertical axis in addition to the wheel 132 rotating about a substantially horizontal axis.

The sensors 162*a-c* are located within the recesses such that all three sensors 162*a-c* are directed toward the surface of the wheel 132, for example, at different locations. Each of the sensors 162*a-c* includes an optical emitter, such as an infrared emitter, for emitting radiation directed toward a surface of the wheel 132 and an optical detector, such as an infrared detector, for detecting radiation reflected from the wheel 132. The wheel 132 includes alternative sections of different reflectivities (e.g., black and white surfaces). The different reflectivities provide different intensities of reflected light when the wheel 132 is rotating, and thus the change in the intensity of the reflected light over a period of time may be used to detect whether or not the non-driven wheel 132 is rotating.

Figure 10:
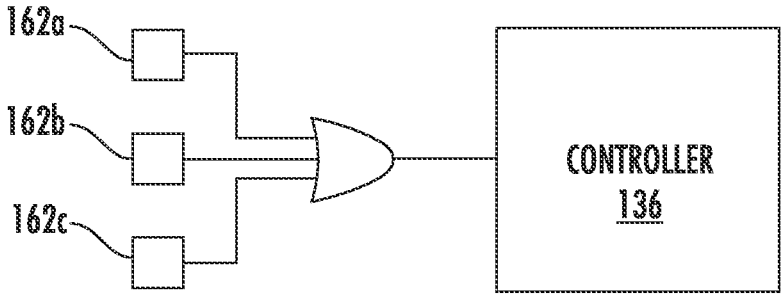
FIG. 10 is a schematic diagram of the optical rotation sensors coupled in an OR circuit configuration to the controller of the robotic vacuum cleaner.

Referring to FIG. 10, the optical rotation sensors 162*a-c* (i.e., the optical detectors) are coupled together in an OR logic configuration such that one output is coupled to the controller 136. As such, the controller 136 will receive an input indicating rotation when any one of the sensors 162*a-c* provides an output indicating rotation. Using multiple optical rotation sensors coupled in an OR circuit configuration allows a more efficient and reliable detection of rotation. In the example embodiment, the optical rotation sensors 162*a-c* are used to detect only rotation or non-rotation and do not provide any rotational speed information. In response to detecting non-rotation from any one of the optical rotation sensors 162*a-c*, the controller 136 may drive the driven wheels 130 in reverse.

Figure 11:
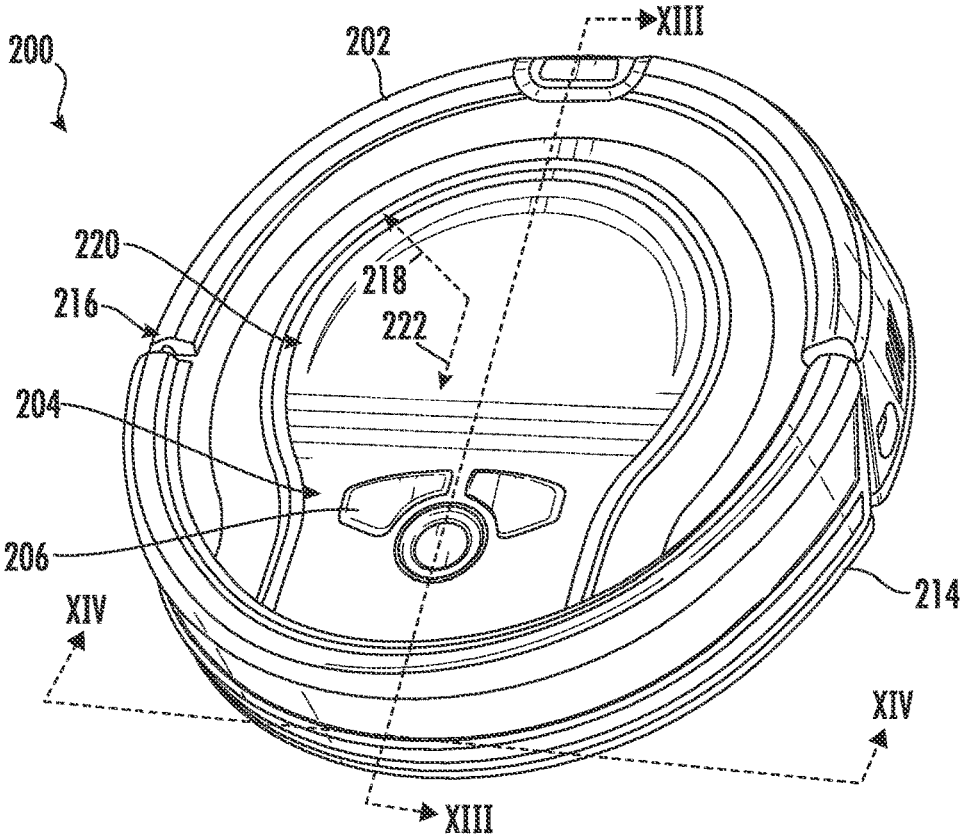
FIG. 11 is a perspective view of a robotic vacuum cleaner, consistent with embodiments of the present disclosure.
Figure 12:
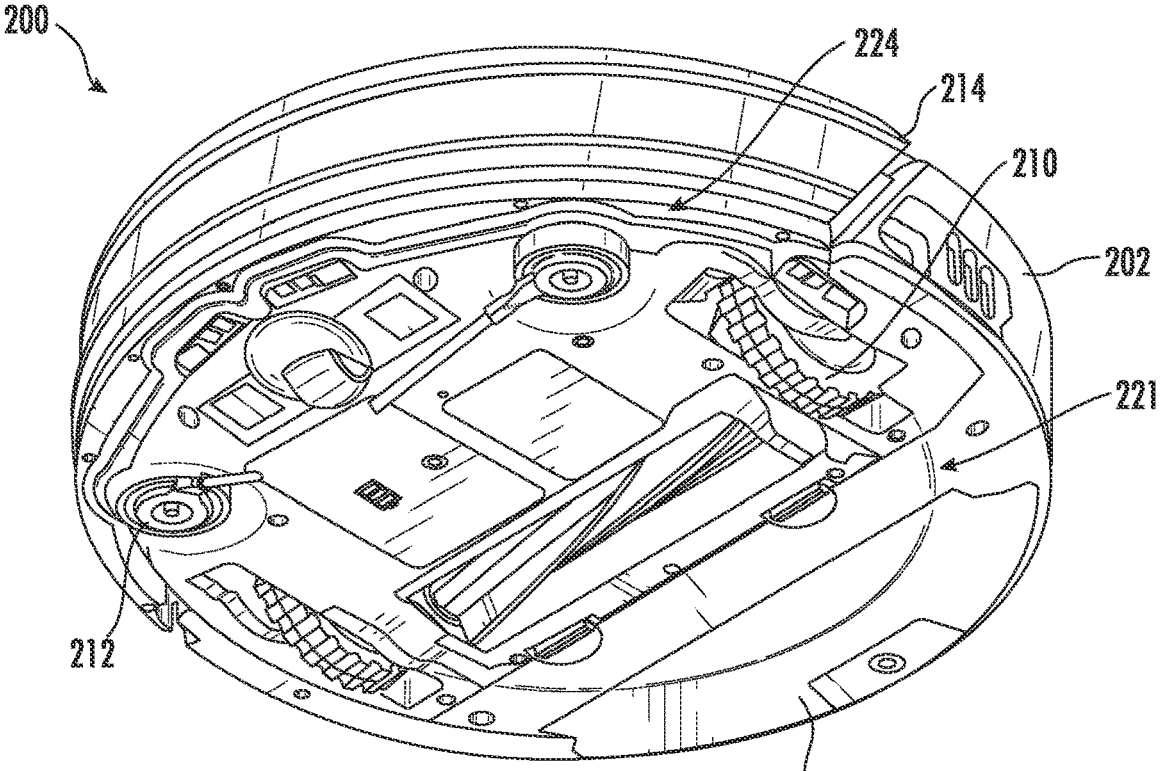
FIG. 12 is another perspective view of the robotic vacuum cleaner of FIG. 11.

FIGS. 11 and 12 show perspective views of a robotic vacuum cleaner 200, consistent with embodiments of the present disclosure. FIG. 11 shows a top perspective view of the robotic vacuum cleaner 200 and FIG. 12 shows a bottom perspective view of the robotic vacuum cleaner 200. As shown, the robotic vacuum cleaner 200 includes a housing 202, controls 204 having a plurality of buttons 206, a debris collector 208, a plurality of drive wheels 210, and a plurality of side brushes 212.

A bumper 214 extends around at least a portion of a perimeter 216 of the housing 202 (e.g., at least 30%, at least 40%, at least 50%, at least 60%, at least 70%, at least 80%, or at least 90% of the perimeter 216). The bumper 214 is configured to move along a vertical axis and/or plane 218 that extends generally perpendicular to a top surface 220 of the housing 202 and along a horizontal axis and/or plane 222 that extends generally parallel to a top surface 220 of the housing 202. In other words, the bumper 214 can be generally described as being movable along at least two axes.

When the bumper 214 is displaced, relative to the housing 202, along the vertical axis and/or plane 218 in response to, for example, engaging (e.g., contacting) an overhanging obstacle (e.g., a portion of a couch extending between two legs), the bumper 214 may cause one or more switches to be actuated. For example, one or more optical switches/light gates (e.g., an infrared break-beam sensor), mechanical pushbutton switches, and/or any other switch can be positioned within the housing 202 such that at least portion of the switch and/or an actuator configured to actuate the switch extends from of the top surface 220 of the housing 202 and engages (e.g., contacts) the bumper 214. In some instances, the switch and/or the actuator configured to actuate the switch can be configured to support at least a portion of the bumper 214 in a position that is spaced apart from the housing 202.

When the bumper 214 is displaced, relative to the housing 202, along the horizontal axis and/or plane 222 in response to, for example, engaging (e.g., contacting) an obstacle extending from a floor (e.g., a wall or a leg of a chair), the bumper 214 may cause one or more switches to be actuated. For example, one or more optical switches/light gates (e.g., an infrared break-beam sensor), mechanical pushbutton switches, and/or any other switch may be positioned within the housing 202 such that at least portion of the switch and/or an actuator configured to actuate the switch extends from a peripheral surface 224 that extends between the top surface 220 and a bottom surface 221 of the housing 202.

In some instances, the bumper 214 can be configured to move along both the horizontal axis 222 and the vertical axis 218 simultaneously. For example, the bumper 214 can move at a different rate along the horizontal axis 222 than the vertical axis 218 based on, for example, one or more characteristics of an encountered obstacle.

The robotic vacuum cleaner 200 can be configured to differentiate between the bumper 214 engaging an overhanging obstacle and an obstacle that extends from a surface to be cleaned (e.g., a floor). For example, the robotic vacuum cleaner 200 may have a first escape behavior that is executed when the bumper 214 engages an overhanging obstacle and a second escape behavior that is executed when the bumper 214 engages an obstacle that extends from a surface to be cleaned. The first escape behavior can be different from the second escape behavior. In some instances, the robotic vacuum cleaner 200 can be configured to have a third escape behavior that is executed when, for example, both an overhanging obstacle and an obstacle extending from a surface to be cleaned is detected. The third escape behavior can be different from at least one of the first and second escape behaviors. The escape behaviors may include one or more of, for example, changing direction (e.g., reversing or turning), generating an alarm (e.g., audible or visual) to get assistance from a user, discontinuing movement, and/or any other suitable behavior. For example, the first escape behavior may include reversing, the second escape behavior may include turning, and the third escape behavior may include generating an alarm.

While the present disclosure generally refers to overhanging obstacles as causing the bumper 214 to be displaced along the vertical axis and/or plane 218, it should be appreciated that, in some instances, an overhanging obstacle may not be spaced apart a sufficient distance from a surface to be cleaned for the overhanging obstacle to urge the bumper 214 along the vertical axis and/or plane 218. For example, the overhanging obstacle can engage a midsection of the bumper 214. In these instances, the overhanging obstacle may cause the bumper 214 to move along the horizontal axis and/or plane 222.

Figure 13:
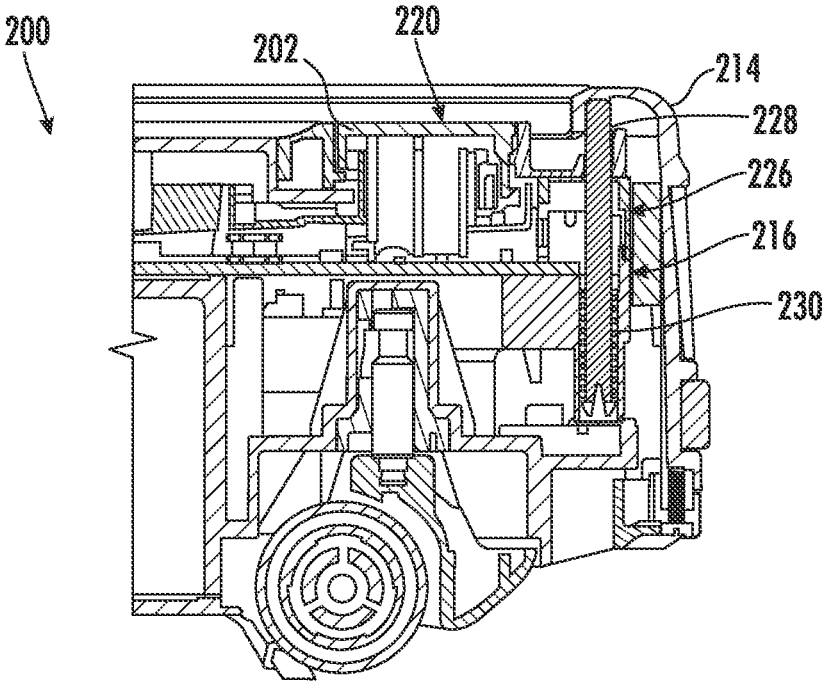
FIG. 13 is a cross-sectional view of the robotic vacuum cleaner of FIG. 11.

FIG. 13 is a cross-sectional view of a portion of the robotic vacuum cleaner 200 taken along the line XIII-XIII of FIG. 12. FIG. 13 shows an example of the bumper 214 being configured to actuate an upper optical switch (or light gate) 226 in response to the bumper 214 engaging an overhanging obstacle. As shown, the bumper 214 is configured to engage (e.g., contact) a plunger 228 of the upper optical switch 226. The plunger 228 is configured to be biased (e.g., by a spring 230) in direction towards the top surface 220 of the housing 202. As such, the plunger 228 can generally be described as supporting the bumper 214 in a position spaced apart from the top surface 220 of the housing 202. When the plunger 228 is depressed an optical beam extending within the upper optical switch 226 is broken, actuating the upper optical switch 226. In other words, the upper optical switch 226 is actuated in response to a movement of the plunger 228. In some instances, a plurality (e.g., at least two, at least three, at least four, at least five, or any other suitable number) of optical switches 226 may be disposed around the perimeter 216 of the housing 202.

While the FIG. 13 shows the plunger 228 directly engaging (e.g., contacting) the bumper 214, other configurations are possible. For example, one or more actuators may be disposed between the bumper 214 and the plunger 228. As such, the actuator can directly engage (e.g., contact) the bumper 214 and be configured such that a movement of the actuator causes a corresponding movement of the plunger 228. In these instances, the actuator may be configured to support the bumper 214 in a position spaced apart from the housing 202.

Figure 14:
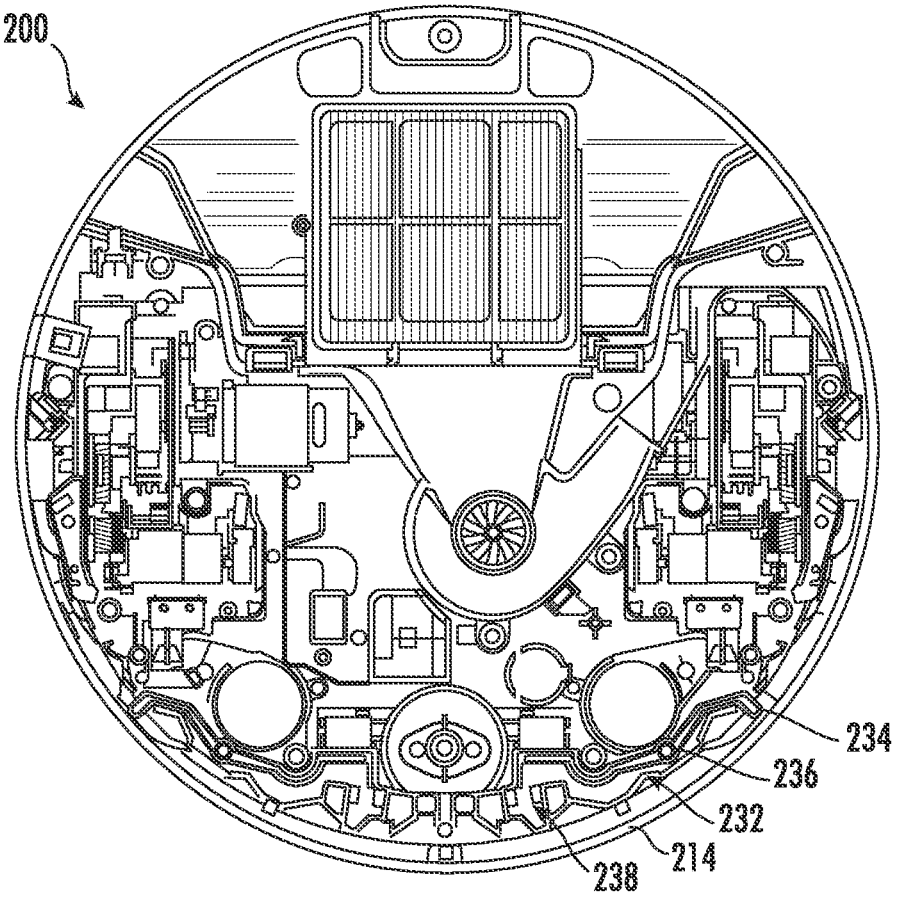
FIG. 14 is another cross-sectional view of the robotic vacuum cleaner of FIG. 11.

FIG. 14 is a cross-sectional view of the robotic vacuum cleaner 200 taken along the line XIV-XIV of FIG. 12. FIG. 14 shows an example of the bumper 214 being configured to actuate a forward optical switch (or light gate) 232 in response to the bumper 214 engaging an obstacle extending from a surface to be cleaned. As shown, when the bumper 214 is displaced rearwardly, the bumper 214 causes a pivot arm 234 of the forward optical switch 232 to pivot about a pivot point 236. A pivot axis about which the pivot arm 234 pivots can extend transverse (e.g., perpendicular) to a surface to be cleaned. As the pivot arm 234 pivots, a portion of the pivot arm 234 breaks a light beam extending between an emitter and detector pair 238 of the forward optical switch 232, actuating the forward optical switch 232.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A robotic cleaner comprising:

a first driven wheel and a second driven wheel, each driven wheel being biased toward an extended position;

a first wheel drop sensor corresponding to the first driven wheel and a second wheel drop sensor corresponding to the second driven wheel, each wheel drop sensor being configured to detect when a corresponding driven wheel is in the extended position; and a controller communicatively coupled to the first and second wheel drop sensors, the controller being configured to determine that the robotic cleaner is perched on a cliff in response to only one of the first wheel drop sensor detecting that the first driven wheel is in the extended position or the second wheel drop sensor detecting that the second driven wheel is in the extended position, wherein, in response to the first wheel drop sensor detecting that the first driven wheel is in the extended position and the controller determining that the robotic cleaner is perched on the cliff, the controller is configured to:

cause:

the first driven wheel to rotate in a rearward rotation direction for a predetermined time; and the second driven wheel to discontinue rotation while the first driven wheel rotates in the rearward rotation direction for the predetermined time; and determine the robotic cleaner is stuck on the cliff when the predetermined time has elapsed and the first wheel drop sensor indicates the first driven wheel is in the extended position.

2. The robotic cleaner of claim 1 further comprising a rotatable side brush, the rotatable side brush including a first group of bristles and a second group of bristles, the first group of bristles having a length longer than that of the second group of bristles.

3. The robotic cleaner of claim 2 further comprising a cliff sensor configured to detect a presence of a floor, wherein, during rotation of the rotatable side brush, the first group of bristles passes between the cliff sensor and the floor and the second group of bristles does not pass between the cliff sensor and the floor.

4. The robotic cleaner of claim 2, wherein the second group of bristles is stiffer than the first group of bristles.

5. The robotic cleaner of claim 1 further comprising a non-driven wheel.

6. The robotic cleaner of claim 5, further comprising optical rotation sensors communicatively coupled to the controller and optically coupled to the non-driven wheel for sensing rotation of the non-driven wheel.

7. The robotic cleaner of claim 6, wherein the optical rotation sensors are coupled together in an OR logic configuration.

8. The robotic cleaner of claim 1, further comprising a bumper, the bumper being movable along at least two axes.

9. A robotic cleaner comprising:

a first driven wheel and a second driven wheel, each driven wheel being mounted on a respective suspension system, each suspension system configured to bias a corresponding driven wheel toward an extended position;

a first wheel drop sensor corresponding to the first driven wheel and a second wheel drop sensor corresponding to the second driven wheel, each wheel drop sensor being configured to detect when a corresponding driven wheel is in the extended position; and a controller communicatively coupled to the first and second wheel drop sensors, the controller being configured to determine that the robotic cleaner is perched on a cliff in response to only one of the first wheel drop sensor detecting that the first driven wheel is in the extended position or the second wheel drop sensor detecting that the second driven wheel is in the extended position, wherein, in response to the first wheel drop sensor detecting that the first drive wheel is in the extended position and the controller determining that the robotic cleaner is perched on the cliff, the controller is configured to:

cause:

the first driven wheel to alternate between rotating in a forward rotating direction and a rearward rotation direction for a predetermine time; and the second driven wheel to discontinue rotation while the first driven wheel rotates in the forward and the rearward rotation directions for the predetermined time; and determine the robotic cleaner is stuck on the cliff when the predetermined time has elapsed and the first wheel drop sensor indicates the first driven wheel is in the extended position.

10. The robotic cleaner of claim 9, wherein each suspension system includes a pivoting gearbox.

11. The robotic cleaner of claim 9 further comprising a rotatable side brush, the rotatable side brush including a first group of bristles and a second group of bristles, the first group of bristles having a length longer than that of the second group of bristles.

12. The robotic cleaner of claim 11 further comprising a cliff sensor configured to detect a presence of a floor, wherein, during rotation of the rotatable side brush, the first group of bristles passes between the cliff sensor and the floor and the second group of bristles does not pass between the cliff sensor and the floor.

13. The robotic cleaner of claim 11, wherein the second group of bristles is stiffer than the first group of bristles.

14. The robotic cleaner of claim 9 further comprising a non-driven wheel.

15. The robotic cleaner of claim 14, further comprising optical rotation sensors communicatively coupled to the controller and optically coupled to the non-driven wheel for sensing rotation of the non-driven wheel.

16. The robotic cleaner of claim 15, wherein the optical rotation sensors are coupled together in an OR logic configuration.

17. The robotic cleaner of claim 9, further comprising a bumper, the bumper being movable along at least two axes.

18. The robotic cleaner of claim 17, wherein movement of the bumper causes one or more switches to be actuated.

19. A robotic cleaner comprising:

a first driven wheel and a second driven wheel, each driven wheel being biased toward an extended position;

a first wheel drop sensor corresponding to the first driven wheel and a second wheel drop sensor corresponding to the second driven wheel, each wheel drop sensor being configured to detect when a corresponding driven wheel is in the extended position; and a controller communicatively coupled to the first and second wheel drop sensors, wherein, in response to the first wheel drop sensor detecting that the first driven wheel is in the extended position, the controller is configured to cause:

the first driven wheel to alternate between rotating in a forward rotation direction and a rearward rotation direction for a predetermined time; and the second driven wheel to discontinue rotation while the first driven wheel rotates in the forward and the rearward rotation directions for the predetermined time.

20. The robotic cleaner of claim 19, wherein the controller is further configured to determine that the robotic cleaner is stuck when the predetermined time has elapsed and the first wheel drop sensor indicates the first driven wheel is in the extended position.

* * * * *